United States Patent [19]

Harada et al.

[11] Patent Number: 4,935,671

[45] Date of Patent: Jun. 19, 1990

[54] THIN-FILM EL DISPLAY PANEL DRIVE

[75] Inventors: Shigeyuki Harada, Nara; Kinichi Isaka, Yamatokoriyama; Toshihiro Ohba, Nara; Masashi Kawaguchi, Nara; Hiroshi Kishishita, Nara; Yoshiharu Kanatani, Nara; Hisashi Uede, Wakayama, all of Japan

[73] Assignee: Sharp Kabushiki Kaisha, Osaka, Japan

[21] Appl. No.: 229,751

[22] Filed: Aug. 8, 1988

Related U.S. Application Data

[63] Continuation of Ser. No. 737,068, May 23, 1985, abandoned.

[30] Foreign Application Priority Data

May 23, 1984 [JP] Japan ..... 59-105375

[51] Int. Cl.[5] ..... H01J 19/14

[52] U.S. Cl. ..... 315/169.3; 315/169.2; 340/781; 340/825.81

[58] Field of Search ..... 315/169.3, 169.2, 107; 340/781, 825.81

[56] References Cited

U.S. PATENT DOCUMENTS

| | | | |
|---|---|---|---|
| 3,885,196 | 5/1975 | Fischer | 340/781 |
| 4,032,818 | 6/1977 | Chan | 315/169.2 |
| 4,338,598 | 7/1982 | Ohba et al. | 340/825.81 |
| 4,367,468 | 1/1983 | Curry | 315/169.2 |
| 4,485,379 | 11/1984 | Kinoshita et al. | 340/825.81 |

*Primary Examiner*—Robert L. Griffin
*Assistant Examiner*—T. Salindong
*Attorney, Agent, or Firm*—Birch, Stewart, Kolasch & Birch

[57] ABSTRACT

When driving a thin-film EL display panel having groups of two electrodes on opposing sides of a thin-film EL layer, a voltage is applied so that the polarity of the AC pulse applied to the intersection (picture element) of opposing electrodes is the reverse of the polarity of the AC pulse applied simultaneously or nearly simultaneously to adjacent or nearly adjacent picture elements. This drive method avoids flicker caused by differing luminance intensities resulting from alternating polarity in EL matrix-type displays.

12 Claims, 7 Drawing Sheets

THIN-FILM EL DISPLAY PANEL DRIVE

This application is a continuation of application Ser. No. 06/737,068 filed on May 23, 1985, now abandoned.

BACKGROUND OF THE INVENTION

This invention concerns a drive for a thin-film electroluminescent (EL) display panel.

At present, a line-film method is used to drive a thin-film EL display panel having a matrix structure, and the upper limit of the frame frequency is limited to some extent by the number of electrodes on the scan side. Recent increases in the display capacity of the EL display panel have been accompanied by an increase in the number of scan-side electrodes, resulting in an incumbent drop in a frame frequency.

FIG. 2 shows a basic structure of the thin-film EL display panel. In this figure, 4 is a ZnS layer which is a luminescent layer of the thin-film EL display panel; manganese and other substances are added as active material forming a luminescent center. Number 3 and 5 are the dielectric layers of $Si_3N_4$, $SiO_2$, $Al_3O_3$, and other materials; 2 is the transparent electrode of indium tin oxide (I.T.O.) on a display side; 6 is the backplate of aluminum; and 1 is a glass substrate.

Though light is produced as electroluminescence when an appropriate AC pulse voltage 7 is applied to a thin-film EL display panel of such a structure, two intermittent light emissions are obtained per one cycle as shown in FIG. 3 (f: frequency). For example, a 120-Hz light emission is obtained for a 60-Hz AC pulse. The level of these two light emissions may vary by a maximum 10% due to an incomplete symmetry in the component structure of the light-emitting layer.

Human sight perceives frequencies below a certain level emitted by an intermittent illuminant as flicker. This limit is said to be 40 to 50 Hz, depending upon personal differences and light waveforms. In the case of thin-film EL display panels, since the emitted pulse will be 60 Hz given an applied AC pulse of 30 Hz, the luminescence should not be perceived as a flicker, but because the two emission levels in each cycle are not equal, the emission is perceived as a 30-Hz flicker by the human eye. This fact is a major drawback to the display quality of thin-film EL display panels.

OBJECT AND SUMMARY OF THE INVENTION

The present invention is an effective means of coping with this problem. By producing two luminescent pulses of different levels nearly simultaneously (1/60=within 16.7 msec) between two near electrodes, the eye to sees equivalent light levels from dissimilar luminescent pulses, thus eliminating the perception of a flicker.

The drive of a thin-film electroluminescent (EL) display panel in the present invention is characterized by the elimination of visible flicker in the luminescence of a display. This is enabled by applying an AC pulse to the intersection (picture element) of opposing electrodes, while the AC pulse being simultaneously or nearly simultaneously applied is of a reverse polarity adjacent or nearly adjacent picture elements to when driving a thin-film EL display panel provided with multiple pairs of opposing electrode groups on both sides of the thin-film EL layer.

DETAILED DESCRIPTION OF THE INVENTION

Figure 4:
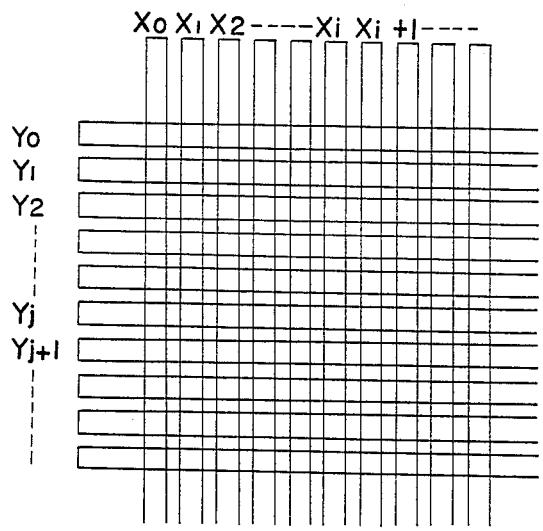
FIG. 4 is an electrode schematic.

FIG. 4 shows the electrode configuration of a thin-film EL display panel. Parallel electrode groups $X_0$, $X_1$, . . . $X_m$ (X electrodes) and $Y_0$, $Y_1$, . . . $Y_n$ are provided on opposing sides of the three layer stratum composed of luminescent and insulation layers. The X electrode and Y electrode groups are arranged so as to mutually intersect on opposing sides of the electroluminescent layer, each intersection forming a luminescent point (picture element).

Figure 5:
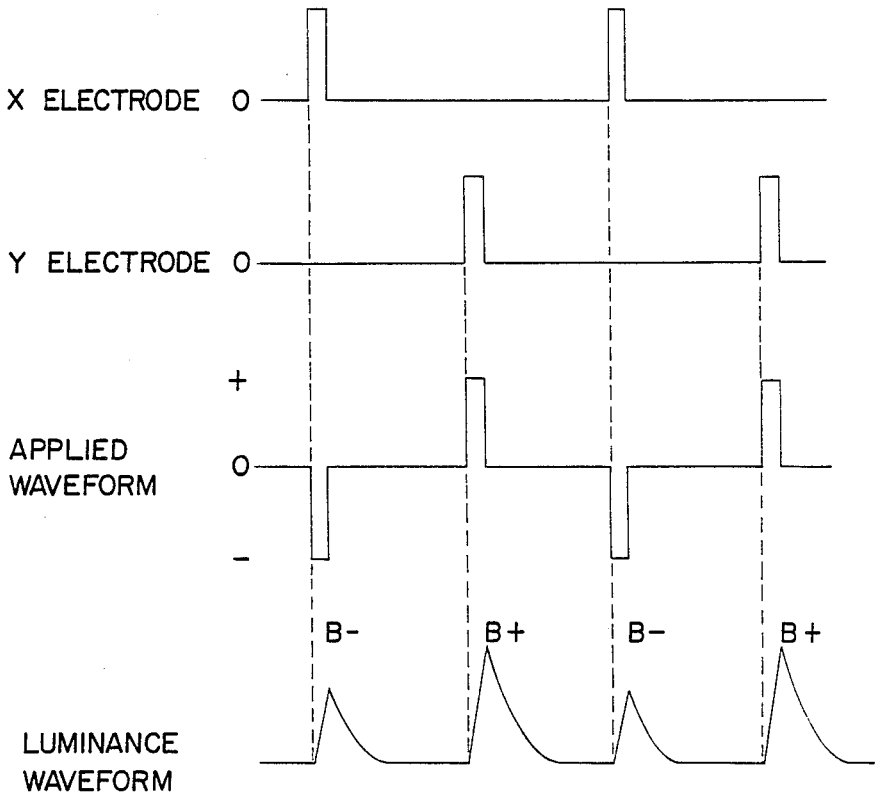
FIG. 5 is a time chart.

FIG. 5 is a time chart showing the luminescence waveform and voltage pulse waveform (applied waveform) applied to the picture element when the pulse voltage shown in FIG. 5 is applied to the X electrode and Y electrode respectively. As shown in the figure, the level of the luminescent pulse differs with a positive and negative Y electrode polarity as seen from the X electrode. For luminescence levels B+ and B−, the ratio r expressing the difference between luminescence levels is approximately $$r=2\,([B+]-[B-]/[B+]+[B-])=0-0.3.$$

In such cases, if the AC frequency is high, e.g. when the applied voltage pulse is greater than 60 Hz, no flicker is perceived, but with low frequencies, e.g. a 30-Hz voltage pulse where the difference in light levels exceeds 5%, most people will perceive a flicker in the luminescence.

Figure 1:
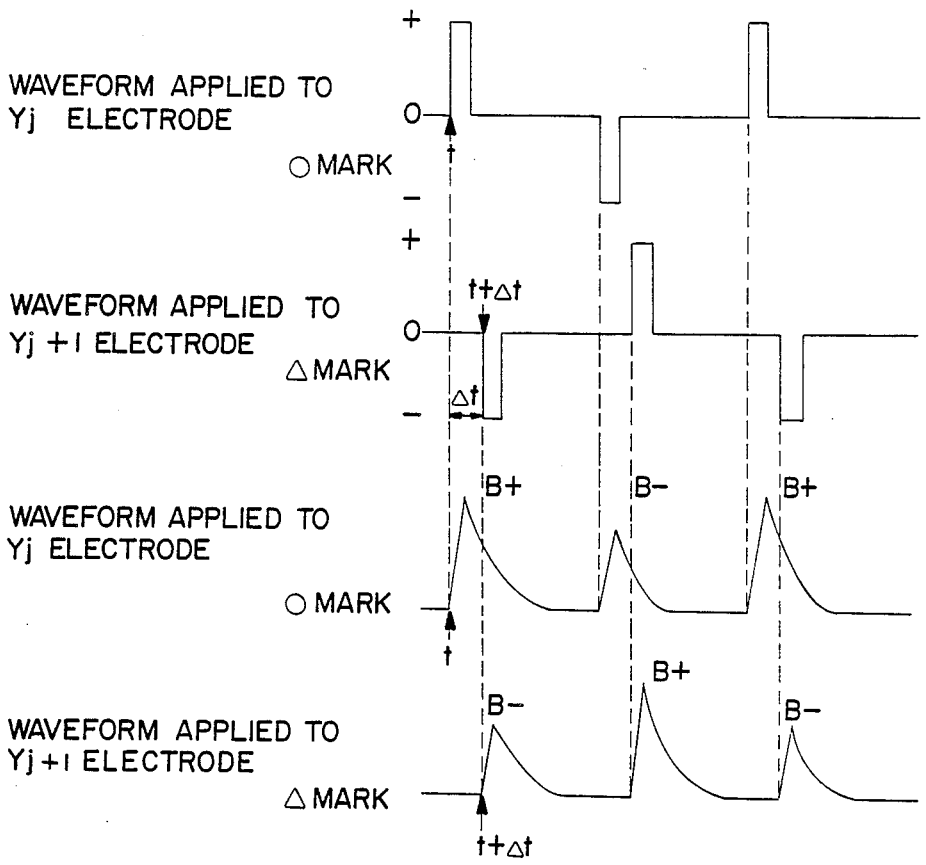
FIG. 1 is a time chart.
Figure 2:
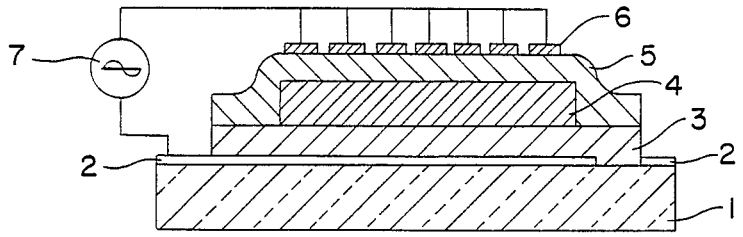
FIG. 2 is a cross-sectional view.
Figure 3:
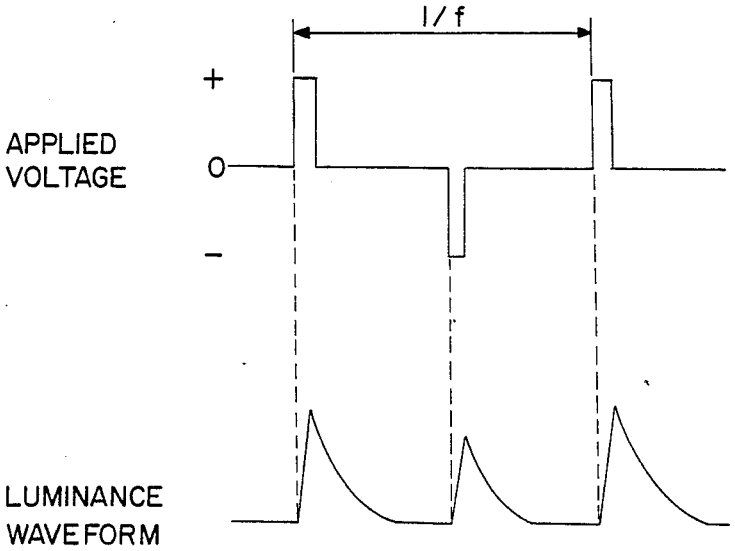
FIG. 3 is a time chart.
Figure 6:
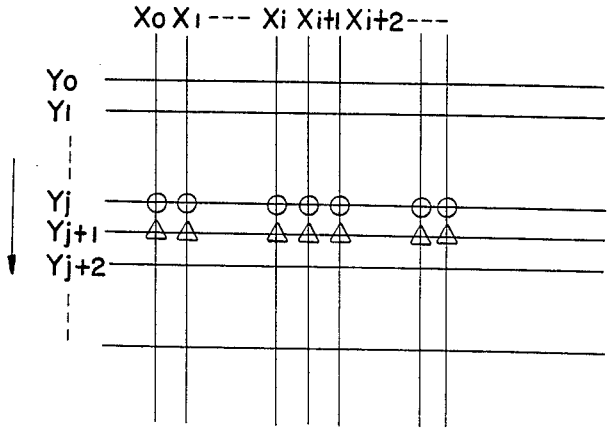
FIG. 6 is an electrode schematic.

The present invention renders flicker imperceptible in such cases; the drive method is shown in FIG. 6 and FIG. 1.

FIG. 1 is the time chart showing the luminescence waveform and AC pulse voltage waveform applied to the picture element at adjacent electrodes $Y_j$, $Y_{j+1}$. As shown in the figure, the pulse applied to the picture element on line $Y_j$ is of reverse polarity to the pulse applied to the picture element on line $Y_{j+1}$; in addition, an application timing difference $\Delta t$ of each pulse within 16.7 msec is also characteristic.

Luminescence of an EL display panel driven completely by the above method consists of light B+ emitted at time t from a picture element on electrode $Y_j$ and light B− emitted at $t+\Delta t$ after $\Delta t$ from a picture element on electrode $Y_{j+1}$, and is perceived by the optical nerve as light emitted simultaneously from virtually the same location (B=0.5 ([B+]+[B−]); this makes it possible to eliminate perceptible asymmetry should such asymmetry exist in the luminescence of the EL display panel, and thus prevents flicker.

A particular characteristic of the present invention is that for a drive with a frame frequency less than 50 Hz, the luminescence waveform of the EL display panel can effectively improve display quality even for a drive with a frame frequency greater than 50 Hz even though luminescence levels are not equal due to the polarity of the applied voltage.

Note that while in the above explanation a reverse polarity pulse is applied to adjacent line electrodes, the same effect can be obtained by applying a reverse pulse every two to three lines.

A specific drive circuit configuration is described below.

Figure 7:
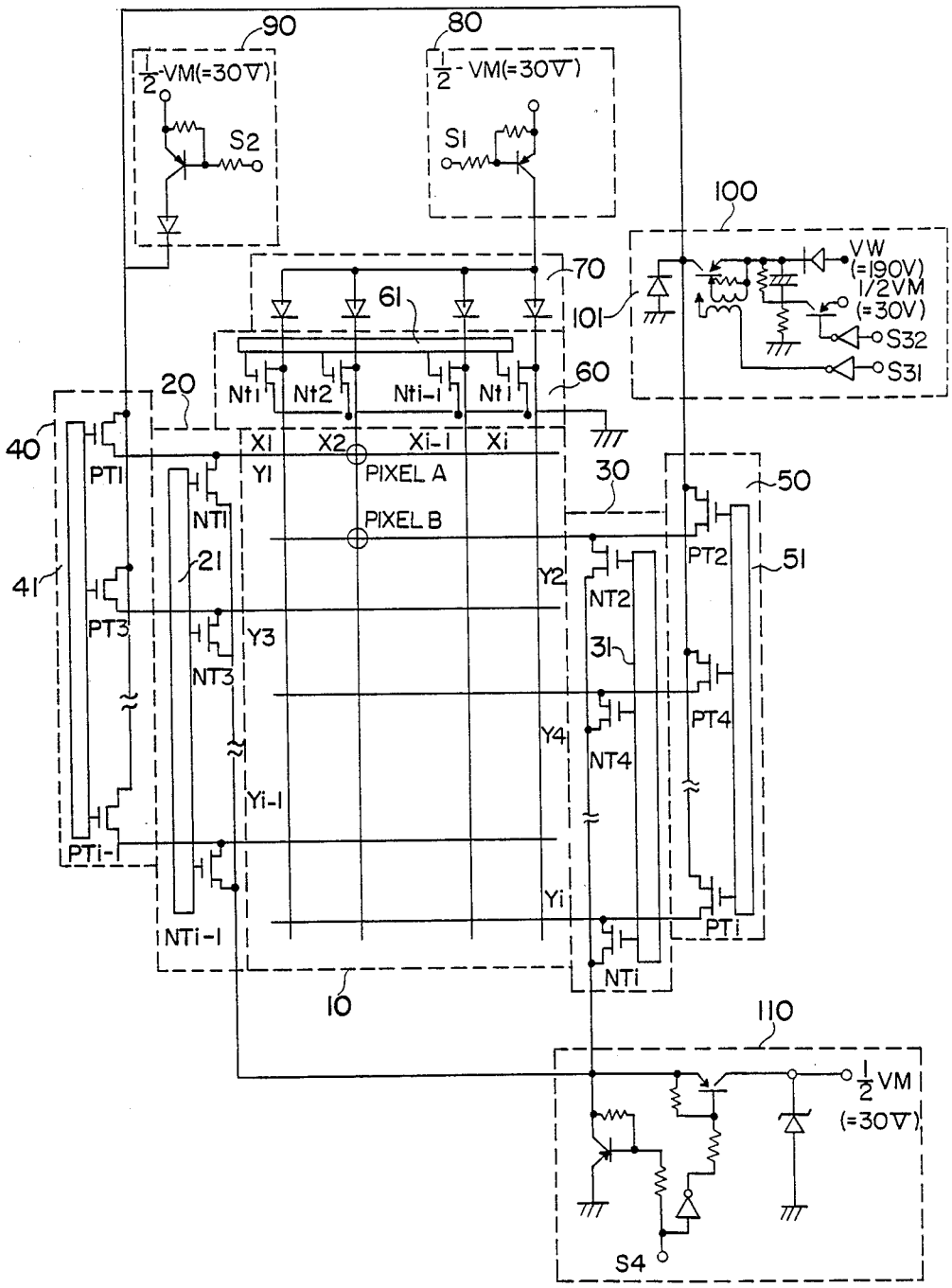
FIG. 7 is a circuit diagram.

FIG. 7 is the circuit diagram showing the drive circuit configuration of the present invention.

In the figure, 10 is the thin-film EL display panel. In this figure the X-axis electrodes are data-side electrodes, and the Y-axis electrodes are scan-side electrodes. Numbers 20 and 30 are each a scan-side N-ch (first-type channel) high voltage resistance MOS IC corresponding, respectively, to odd lines and even lines of the Y-axis electrodes; 21 and 31 are each a logic circuit such as a shift resistor, etc., in each IC. Numbers 40 and 50 are P-ch (second-type channel) high voltage resistance MOS ICs on the same scan side; 41 and 51 are each a logic circuit such as a shift resistor, etc., in each IC. Number 60 is a data-side N-ch high voltage resistance MOS IC; 61 is a logic circuit such as a shift resistor, etc., in the IC. Number 70 is a data-side diode array; this separates the data-side drive lines and provides switching element reverse bias protection. Number 80 is a precharge drive circuit. Number is a pickup charge drive circuit. Number 100 is a write drive circuit. In addition, 110 is a source potential selector circuit for the scan-side N-ch high voltage resistance MOS ICs 20 and 30, and is normally sustained at a ground potential.

Figure 8:
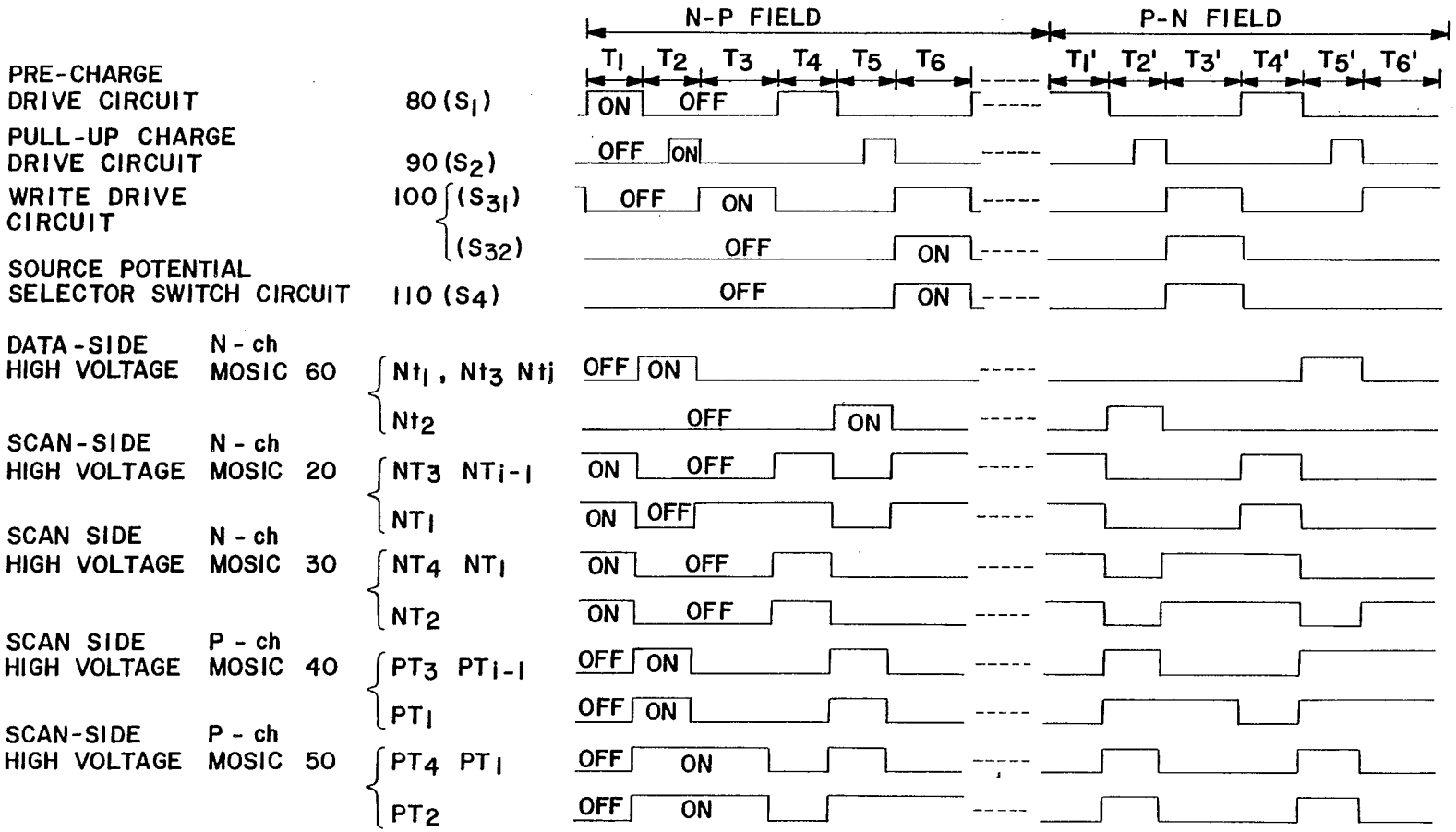
FIG. 8 and FIG. 9 are time charts.
Figure 9:
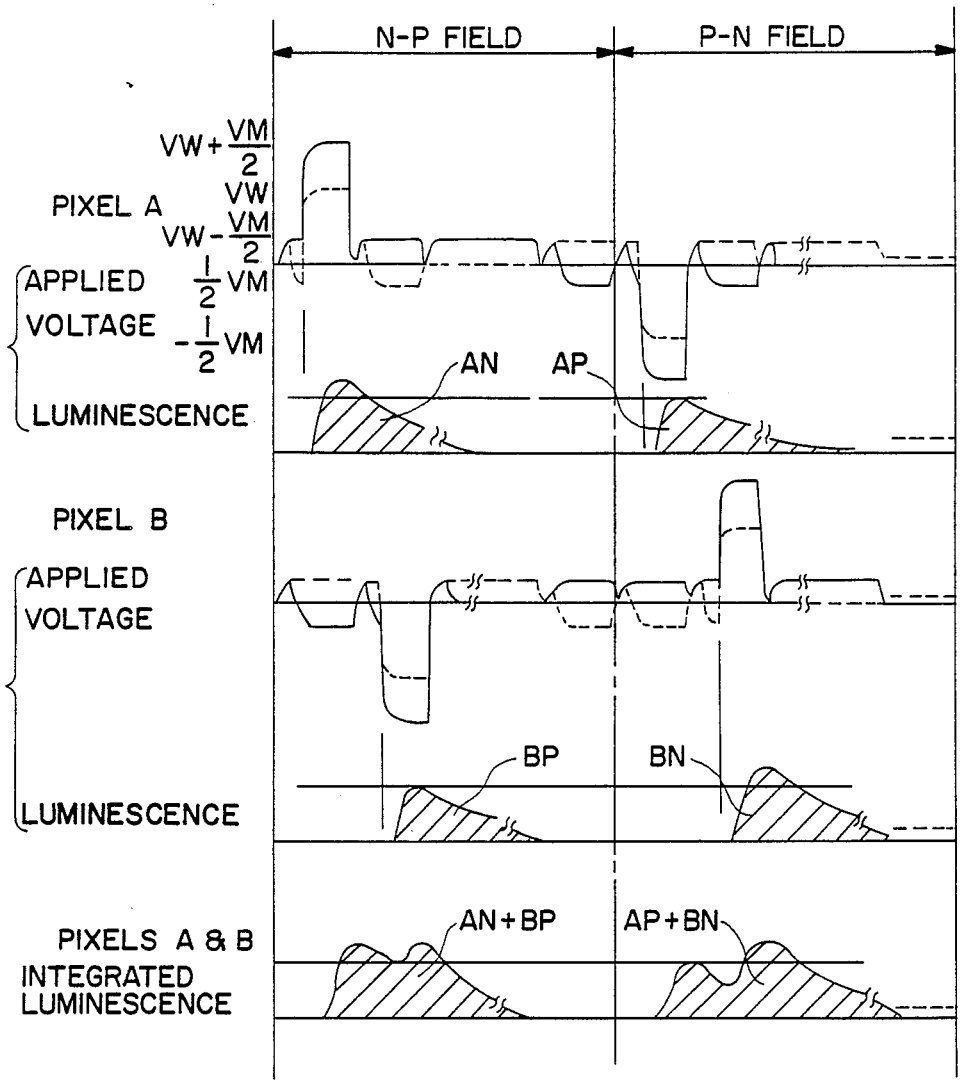

FIG. 8 shows the ON/OFF timing for each high voltage resistance MOS transistor, each drive circuit, and the potential selector circuit. FIG. 9 shows the applied voltage waveforms and the luminescence waveforms representative of picture elements A and B in FIG. 7.

The following description of the proposed panel drive operation refers to FIG. 8 and FIG. 9. Note that in this description scan-side electrodes $Y_1$ including picture element A and $Y_2$ including picture element B have been selected by linear sequential driving. As will be explained, the polarity of the voltage applied to the picture elements of every other line is reversed. The field which applies a positive write pulse to the picture elements on odd lines is called the N-P field; the field which applies a positive write pulse to the picture elements on even lines is called the P-N field.

N-P FIELD (A) The description will begin with the drive of the first line (odd line) including picture element A.

First state $T_1$: precharge interval (odd line)

First, source potential selector circuit 110 is set to the ground potential, and all MOS transistors $NT_1$ to $NT_i$ in a scan-side N-ch high voltage resistance MOS IC 20 and 30 are turned ON. Precharge drive circuit 80 (voltage $\frac{1}{2}$ VM=30 V) simultaneously is turned ON, and the full panel is charged via data-side diode array 70. At this time all MOS transistors $Nt_1$ to $Nt_j$ in data-side N-ch high voltage resistance MOS IC 60 and MOS transistors $PT_1$ to $PT_i$ in the scan-side P-ch high voltage resistance MOS IC 40 and 50 are turned OFF.

Second state $T_2$: discharge/pickup charge interval (odd line)

Next, all MOS transistors $NT_1$ to $NT_i$ in the scan-side N-ch high voltage resistance MOS IC. Numbers 20 and 30 are turned OFF. In addition, only the MOS transistor ($Nt_2$) connected to the selected data-side drive electrodes (e.g. $X_2$) in data-side N-ch high voltage resistance MOS IC 60 is left OFF, while the other MOS transistors $Nt_1$ and $Nt_3$ to Ntj connected to data-side drive electrodes are turned ON. Furthermore, MOS transistors $PT_1$ to $Pt_i$ in scan-side P-ch high voltage resistance MOS IC 40 and 50 are turned ON. The load of data-side non-selected electrodes ($X_j \neq 2$) is discharged by a ground loop created by the MOS transistors $Nt_1$ to $Nt_j$ (except for $Nt_2$) of the data-side N-ch high voltage resistance MOS IC 60 which is in the ON state and thus set to ground potential, all MOS transistors $PT_1$ to $PT_i$ in the scan-side P-ch high voltage resistance MOS ICs 40 and 50, and diode 101 in write drive circuit 100.

After this, the pickup charge drive circuit 90 (voltage $\frac{1}{2}$ VM+30 V) is turned ON, and all scan-side electrodes are raised to a 30-V potential. At this time all MOS transistors $NT_1$ to $NT_i$ in scan-side N-ch high voltage resistance MOS ICs 20 and 30 are turned OFF. Accordingly, the selected data-side electrodes ($X_2$) becomes +30 V, and the non-selected data-side electrodes ($X_j \neq 2$) become −30 V relative to scan-side electrodes (Y).

Third stage $T_3$: write drive interval (odd line)

At this point because the linear sequential drive-selected scan-side electrode is $Y_1$, only MOS transistors $NT_1$ connected to $Y_1$ in the scan-side N-ch high voltage resistance MOS IC 20 is switched ON, and all MOS transistors PTl to $Pt_{i-1}$ in the odd line scan-side P-ch high voltage resistance MOS IC 40 are OFF. At this time all MOS transistors $PT_2$ to $PT_i$ in the opposing even line scan-side P-ch high voltage resistance MOS IC 50 are turned ON. By simultaneously switching write drive circuit 100 (voltage VW=190 V at this point) ON, all even-number scan-side electrodes are raised to 190 V via MOS transistors PT2 to PTi in even line P-ch high voltage resistance MOS IC 50. Accordingly, data-side selected electrodes are pulled up to VW+0.5 VM=220 V, and data-side non-selected electrodes are pulled up to VW−0.5 VM=160 V due to capacitive coupling.

(B) The following describes the drive of the second line (even line) including picture element B.

Fourth state $T_4$: precharge interval (even line)

This precharge interval is identical to the first state N-P field.

Fifth stage $T_5$: discharge/pickup charge interval (even line)

Next, all MOS transistors $NT_1$ to $NT_i$ in the scan-side N-ch high voltage resistance MOS IC 20 and 30 are turned OFF. In addition, only the selected MOS transistor (e.g. $Nt_2$) connected to the selected data-side drive electrodes in data-side N-ch high voltage resistance MOS IC 60 is turned ON, while the other MOS transistors $Nt_1$ to Ntj (except Nt2) connected to data-side drive electrodes are turned OFF. Furthermore, MOS transistors $PT_1$ to $PT_i$ in scan-side P-ch high voltage resistance MOS IC 40 and 50 simultaneously are turned ON. The load of data-side selected electrodes is discharged by a ground loop created by MOS transistor $Nt_2$ of data-side N-ch high voltage resistance MOS IC 60 in the ON state, all MOS transistors $PT_1$ to $Pt_i$ in the scan-side P-ch high voltage resistance MOS ICs 40 and 50, and diode 101 in the write drive circuit 100.

After this, pickup charge drive circuit 90 is turned ON, and all scan-side electrodes are raised to a $\frac{1}{2}$ VM=30 V potential. At this time all MOS transistors $NT_1$ to $Nt_i$ in the scan-side N-ch high voltage resistance MOS ICs 20 and 30 are turned OFF. Accordingly, the selected data-side electrode ($X_2$) becomes −30 V, and the non-selected data-side electrodes ($X_{j\neq 2}$) become +30 V relative to scan-side electrodes (Y).

Sixth stage $T_6$: write drive interval (even line)

If the selected scan-side electrode, is $Y_2$, only the MOS transistor PT2 connected to $Y_2$ in the scan-side P-ch high voltage resistance MOS IC 50 is ON, and all others are switched OFF. Also, all the MOS transistors $NT_2$ to $Nt_i$ in odd line scan-side N-ch high voltage resistance MOS IC 30 are sustained in the OFF state, while all MOS transistors $NT_1$ to $NYT_{i-1}$ in the opposing odd line scan-side N-ch high voltage resistance MOS IC 20 are turned ON. Also, the write drive circuit 100 (voltage VW=the sum of 190 V and ½VM=30 V) is turned ON, and a 220-V current is applied to scan-side electrode $Y_2$ via MOS transistor $PT_2$ in the ON state. Source potential selector circuit 110 is switched to the voltage ½VM=30 V, and the source potential of odd line scan-side N-ch high voltage resistance MOS IC 20 thus becomes 30 V, and the odd scan-side electrodes are pulled down to +30 V.

Accordingly, data-side drive electrode $X_2$ is pulled down to −220 V, and non-selected data-side electrode $X_{j\neq 2}$ is pulled down to −160 V due to capacitive coupling.

N-P field drive is completed by sequentially performing first stage $T_1$ through third stage $T_3$ on all the odd lines and fourth state $T_4$ through sixth stage $T_6$ on all the even lines as described above.

P-N Field (A) Next, P-N field drive is conducted from the first line (odd line) including picture element A.

First stage $T_1'$: precharge interval (odd line)

This precharge interval is identical to the N-P field first stage.

Second stage $T_2'$: discharge/pickup charge interval (odd line)

This discharge/pickup charge interval is identical to the N-P field fifth stage.

Third stage $T_3'$: write drive interval (odd line)

If the selected scan-side electrode is $Y_1$, only the MOS transistor $PT_1$ connected to $Y_1$ in scan-side P-ch high voltage resistance MOS IC 40 is sustained ON, and all others are switched OFF. Also, all MOS transistors $NT_1$ to $NT_{1-1}$ in the odd line scan-side N-ch high voltage resistance MOS IC 20 are sustained in an OFF state, and all MOS transistors $NT_2$ to $NT_i$ in the opposing even line scan-side N-ch high voltage resistance MOS IC 30 are switched ON. Also, write drive circuit 100 (voltage VW=the sum of 190 V and ½VM=30 V) is turned ON, and a 220-V current is applied to the scan-side electrode $Y_1$ via the MOS transistor $PT_1$ which is in the ON state. Also, the source potential selector circuit 110 is switched to the voltage ½M=30 V, with the source potential of even line scan-side N-ch high voltage resistance MOS IC 30 thus becoming 30 V, and the even-number scan-side electrodes being pulled down to +30 V. Accordingly, data-side drive electrode $X_2$ is pulled down to −220 V, and non-selected data-side electrode $X_j$16 3 is pulled down to −160 V due to capacitance coupling.

(B) The following describes the drive of the second line (even line) including picture element B.

Fourth stage $T_4'$: precharge interval (even line)

This precharge interval is identical to the first stage N-P field.

Fifth stage $T_5'$: discharge/pickup charge interval (even line)

This discharge/pickup charge interval is identical to the second stage N-P field.

Sixth stage $T_5'$: write drive interval (even line)

At this point because the linear sequential drive-selected scan-side electrode is $Y_2$, only MOS transistor $NT_2$ connected to $Y_2$ in scan-side N-ch high voltage resistance MOS IC 30 is turned ON, and all MOS transistors $PT_2$ to $PT_i$ in the even-number line scan-side P-ch high voltage resistance MOS IC 50 are turned OFF. At this time all MOS transistors $PT_1$ to $PT_{i-1}$ in the opposing odd line scan-side P-ch high voltage resistance MOS IC 40 are turned ON. By simultaneously switching the write drive circuit 100 (voltage VW=190 V at this point) ON, all odd scan-side electrodes are raised to 190 V vi a MOS transistors $PT_1$ to $PT_{i-1}$ in the odd line P-ch high voltage resistance MOS IC 40. Accordingly, data-side selected drive electrodes are pulled up to VW+0.5 VM=220 V, and data-side non-selected electrodes are pulled up to VW−0.5 VM=160 V due to capacity coupling.

P-N field drive is completed by sequentially performing from first stage $T_1'$ to third stage $T_3'$ on the odd lines and from fourth stage $T_4'$ to sixth stage $T_5'$ on the even line side as described above.

By sequentially repeating the above P-N field and P-N field drive process described above, a write voltage VW+½ VM (=220 V) with reverse polarity in the N-P field and the P-N field and sufficient voltage to induce electroluminescence at selected intersecting picture elements can be applied as is shown in the FIG. 9 time chart. In other words, the two fields N-P and P-N close the AC cycle required for a thin-film EL display panel. Although VW−½ VM (=160 V) is applied to non-selected picture elements, this is insufficient to induce light emission.

Furthermore, by applying positive and negative write voltages to every other line, the difference in luminescence in each field can be eliminated ($A_N$ and $A_P$ in the luminescence waveform of picture element A and $B_P$ and $B_N$ in the light emission waveform of picture element B shown in FIG. 9 have respective differences in luminescence, but are equivalent to ($A_N+B_P$) and ($A_P+B_N$) in the integrated picture elements A and B luminescence waveform), and flicker which is caused by differing light intensities in every other field generated when positive and negative write voltages are applied to every other field can be reduced or prevented. Although an actual difference in luminance intensity exists between adjacent lines at this time, it is averaged and visually imperceptible.

In a field inversion driver equipped with an N-ch high voltage resistance MOS driver and P-ch high voltage resistance MOS driver as a scan-side drive circuit, varying the write waveform polarity applied to the picture element on every other line averages the luminance dispersion caused by the applied voltage polarities of the panel; this averaging reduces the flicker and enables the proposal of a practical drive method offering favorable results in terms of display quality.

Furthermore, varying the polarity of the write waveform applied to picture elements every several lines to average luminance dispersion and reduce flicker does not detract from the fundamental principle of the present invention.

As described above, the fundamental principle of the present invention is the mutual reversal of applied voltage polarities for the linear sequential drive of an EL display panel to average light level differences arising from the polarities of luminance intensity caused by the overlapping of light, and thereby reduce flicker.

As discussed in detail above, the present invention enables the prevention of flicker and a significant improvement in display quality, and enables the proposal of an extremely valuable thin-film EL display panel drive.

What is claimed is:

1. A method of driving an electroluminescent display panel including an electroluminescent layer disposed between a group of scanning electrodes and a group of data electrodes, a plurality of pixels being defined by the intersections of said scanning electrodes and said data electrodes comprising:

(a) applying a first voltage pulse of a first polarity to selected pixels of a first scanning electrode line or a group of scanning electrode lines;

(b) applying a second voltage pulse, juxtaposed in time to said first voltage pulse and of a second polarity opposite to said first polarity, to selected pixels of a second scanning electrode line or a group of scanning electrode lines substantially adjacent to said first scanning electrode line or group of scanning electrode lines to thereby mask perceived display flicker.

2. A method of driving an electroluminescent display panel including an electroluminescent layer disposed between a group of scanning electrodes and a group of data electrodes, a plurality of pixels being defined by the intersections of said scanning electrodes and said data electrodes, said scanning electrodes being arranged in alternating even and odd groups, comprising:

(a) applying a first voltage pulse of a first polarity to selected pixels of an odd scanning electrode line;

(b) applying a second voltage pulse, juxtaposed in time to said first voltage pulse and of a second polarity opposite to said first polarity, to selected pixels of an even scanning electrode line adjacent to said odd scanning electrode line;

repeating said steps of (a) and (b) to successive odd and even scanning electrode lines until said first and second voltage pulses have been applied to all selected pixels of each scanning electrode line.

3. A method as recited in claim 2 further comprising the steps of:

(c) applying a pulse having said second voltage to selected pixels of each odd scanning electrode line;

(d) applying a pulse having said first voltage and being juxtaposed in time to said pulse having said second voltage to selected pixels of an even scanning electrode line adjacent to said odd scanning electrode line;

repeating said steps of (c) and (d) to successive odd and even scanning lines until said pulses of said first and second voltages have been applied to all selected pixels of each scanning electrode line.

4. A method as recited in claim 3, wherein said steps of applying a pulse having a first voltage include, precharging all said pixels with a precharge voltage;

discharging all said pixels associated with non-selected data electrodes while applying a pull-up voltage to leave only those pixels associated with a selected data electrode charged; and applying a first writing pulse of said first polarity to said scanning electrodes of one of said odd or even groups to which said selected pixels are not associated, a selected scanning lines associated with said selected pixels being grounded, said applied voltage pulling up said one of said groups of scanning electrodes to form said first writing pulse when superimposed on said precharge voltage remaining in said selected data electrode.

5. A method, as recited in claim 4, wherein said steps of applying a pulse having a second voltage include, precharging all said pixels with a precharge voltage;

discharging all said pixels associated with a selected data electrode while applying a pull-up voltage to leave only those pixels associated with non-selected data electrodes charged;

applying a second writing pulse of said second polarity to said selected pixels by applying a voltage directly to said scanning electrodes of one of said odd or even groups to which said selected pixels are associated while applying a source potential voltage to said other group of said odd or even groups, a net voltage being applied to said pixels.

6. A drive system for a thin-film electroluminescent (EL) matrix display panel comprising:

data side electrodes formed on one major surface of the thin-film electroluminescent (EL) matrix display panel substantially along a first direction;

scanning side electrodes formed on the opposing major surface of said thin-film electroluminescent (EL) matrix display panel in a second direction substantially perpendicular to said first direction, said scanning side electrodes being alternately divided into odd number scanning electrodes and even number scanning electodes;

a pull-up charge driving circuit;

a precharge driving circuit;

a write driving circuit for providing a first and a second write pulse;

a source level switching circuit;

an odd side first type channel high voltage MOS driver connected to said odd number scanning electodes at one end thereof, the other end of said odd side first type channel high voltage MOS driver being connected to said source level switching circuit;

an odd side second type channel high voltage MOS driver connected to said odd number scanning electrodes at one end thereof, the other end of said odd side second type channel high voltage MOS driver being connected to said pull-up charge driving circuit and said write driving circuit;

an even side first type channel high voltage MOS driver connected to said even number scanning electrodes at one end thereof, the other end of said even side first type channel high voltage MOS driver being connected to said source level switching circuit;

an even side second type channel high voltage MOS driver connected to said even number scanning electrodes at one end thereof, the other end of said even side second type channel high voltage MOS driver being connected to said pull-up charge driving circuit and said write driving circuit; and a data side first type channel high voltage MOS driver connected to said data side electrodes at one end thereof, the other end of said data side first type channel high voltage MOS driver being connected to a ground level;

switching means for sequentially switching between a first and second driving field;

said odd side second type channel MOS driver providing said first write pulse to said odd number scanning electrodes when an even number scanning electrode is selected in said first driving field and providing said second write pulse to a selected odd number scanning electrode when in said second driving field;

said even-side second type channel MOS driver providing said first write pulse to said even number scanning electrodes when an odd number scanning electrode is selected in said first driving field and providing said second write pulse to a second even number scanning electrode in said second driving field;

said first write pulse provided being of a polarity opposite to said second write pulse in the time juxtaposed application of said first and second write pulses to adjacent scanning side electrodes reducing perceptible display flicker.

7. The method of claim 1 wherein each said scanning line of said pixels is driven by an alternating voltage of said first and second pixels.

8. A method of driving an electroluminescent matrix display panel having a plurality of pixels arranged in odd and even scan lines, comprising:

(a) driving pixels of said even scan lines with a first alternating voltage waveform having first and second pulses of opposite voltage polarity;

(b) driving pixels of said odd scan lines with a second alternating voltage waveform having said first and second pulses of opposite voltage polarity;

said steps (a) and (b) of driving a said second pulse of said second alternating voltage waveform to each said odd scan line adjacent a said even scan line juxtaposed in time with the application of a said first pulse of said first alternating voltage waveform and applying a said first pulse of said second alternating voltage waveform to each said odd scan line adjacent a said even scan line juxtaposed in time with the application of a said second pulse of said first alternating waveform thereby masking perceived display flicker.

9. The method of claim 3 wherein said steps (a) and (b) of applying develop a series of first frame pulses and said steps (c) and (d) of applying develop a series of second frame pulses;

the first frame pulses and second frame pulses of each said scanning electrode line having a constant phase difference therebetween.

10. A drive system for an electroluminescent (EL) matrix display panel comprising:

a plurality of data electrodes formed on a first major surface of said matrix display panel and generally extending in a first direction;

a plurality of scanning electrodes formed on a second major surface of said matrix display panel in a direction orthagonal to said first direction, said scanning electrodes being arranged in odd and even scanning electrode groups having their electrodes alternately arranged on said second major surface;

said first and second major surfaces of said matrix display panel being separated by an electroluminescent material, said scanning electrodes and said data electrodes intersecting to form picture elements at each of the intersections therebetween;

scanning drive means connected to said scanning electrodes for sequentially supplying said scanning electrodes with write voltage pulses, said drive means driving said odd and even scanning electrodes in first and second fields, said odd scanning electrodes being driven with a positive write voltage during the first field and a negative write voltage during the second field;

data drive means connected to said data electrodes for selectively charging or discharging each said data electrode with a modulation voltage to selectively develop a net voltage between a said scanning electrode supplied a write voltage and each said selected data side electrode to selectively color the picture elements formed at the intersections thereof;

the application of a positive write voltage and a negative write voltage to alternate scanned electrodes in each frame reducing perceptible display flicker.

11. The drive system of claim 10, wherein said modulation voltage is applied to a said data electrode associated with a picture element simultaneous to the application of a said write voltage pulse to said picture element.

12. The drive system of claim 10, wherein said scanning drive means includes, an odd side first type channel high voltage driver connected to said odd scanning electrodes for applying positive write voltage thereto, an odd side second type channel high voltage driver connected to said even scanning electrodes for applying negative write voltage thereto, an even side first type channel high voltage drive connected to said even scanning electodes for applying positive write voltages thereto; and an even side second type channel high voltage driver connected to said odd scanning electrodes for applying negative write voltages thereto.

* * * * *